US012781316B2

(12) United States Patent
Hattendorf et al.

(10) Patent No.: US 12,781,316 B2
(45) Date of Patent: Nov. 3, 2026

(54) USE OF A NICKEL-IRON-CHROMIUM ALLOY HAVING HIGH RESISTANCE IN CARBURIZING AND SULFIDIZING AND CHLORINATING ENVIRONMENTS AND SIMULTANEOUSLY GOOD PROCESSABILITY AND STRENGTH

(71) Applicant: VDM Metals International GmbH, Werdohl (DE)

(72) Inventors: Heike Hattendorf, Werdohl (DE); Nicole De Boer, Schwanstetten (DE)

(73) Assignee: VDM Metals International GmbH, Werdohl (DE)

( * ) Notice: Subject to any disclaimer, the term of this patent is extended or adjusted under 35 U.S.C. 154(b) by 309 days.

(21) Appl. No.: 18/841,827

(22) PCT Filed: Apr. 20, 2023

(86) PCT No.: PCT/DE2023/100282

§ 371 (c)(1),
(2) Date: Aug. 27, 2024

(87) PCT Pub. No.: WO2023/208277

PCT Pub. Date: Nov. 2, 2023

(65) Prior Publication Data

US 2025/0163549 A1 May 22, 2025

(30) Foreign Application Priority Data

Apr. 28, 2022 (DE) ..... 10 2022 110 383.8

(51) Int. Cl.
*C22C 30/00* (2006.01)
*C22C 30/02* (2006.01)

(52) U.S. Cl.
CPC ..... *C22C 30/00* (2013.01); *C22C 30/02* (2013.01)

(58) Field of Classification Search
CPC ..... C22C 30/00; C22C 30/02
See application file for complete search history.

(56) References Cited

U.S. PATENT DOCUMENTS 3,833,358 A 9/1974 Bellot et al.
3,865,581 A 2/1975 Sekino et al.
(Continued)

FOREIGN PATENT DOCUMENTS

DE 1 024 719 B 2/1958
DE 41 30 139 C1 8/1992
(Continued)

OTHER PUBLICATIONS

English translation of the International Preliminary Report on Patentability and Written Opinion of the International Searching Authority in PCT/DE2023/100282, mailed Nov. 7, 2024.
(Continued)

*Primary Examiner* — Ricardo D Morales
(74) *Attorney, Agent, or Firm* — Collard & Roe, P.C.

(57) ABSTRACT

A nickel-iron-chromium alloy having excellent high-temperature corrosion resistance is used as a semi-finished product in simultaneously carburizing, sulfidizing and chlorinating environments, the alloy including (in wt. %): 35.0 to 38% nickel, 26.0 to 30.0% chromium, >0.7 to 1.50% silicon, 0.40 to 1.30% aluminum, 0.00 to 1.0% manganese, 0.0001 to 0.05% each of magnesium and/or calcium, 0.015 to 0.12% carbon, 0.001 to 0.150% nitrogen, 0.001 to 0.030% phosphorus, 0.0001 to 0.020% oxygen, a maximum of 0.010% sulfur, less than 1.0% molybdenum, less than 1.0% cobalt, less than 0.5% copper, less than 1.0% tungsten, the remainder being iron and the usual process-related impurities, it being necessary to satisfy the following equation:
(Continued)

$Fc=-1.2+0.29*Ni-4.6*Si-4.4*Al<2.5$ (1 a), where Ni, Si and Al are the concentration of the elements in question in wt. %.

15 Claims, 1 Drawing Sheet

(56) References Cited

U.S. PATENT DOCUMENTS

| | | | |
|---|---|---|---|
| 5,012,215 | A | 4/1991 | Floc'h |
| 5,603,891 | A | 2/1997 | Brill |
| 6,623,869 | B1 | 9/2003 | Nishiyama et al. |
| 7,118,636 | B2 | 10/2006 | Chen et al. |
| 7,736,618 | B2 | 6/2010 | Redlingshoefer et al. |
| 11,098,389 | B2 | 8/2021 | Hattendorf et al. |
| 2009/0285717 | A1 | 11/2009 | Hattendorf |
| 2016/0289807 | A1 | 10/2016 | Hattendorf |
| 2022/0205066 | A1 | 6/2022 | Schmidt et al. |
| 2024/0271252 | A1* | 8/2024 | Yang ..... C22C 33/04 |

FOREIGN PATENT DOCUMENTS

| | | | |
|---|---|---|---|
| DE | 10 2007 005 605 | A1 | 8/2008 |
| DE | 10 2014 001 328 | A1 | 8/2015 |
| DE | 10 2014 001 329 | A1 | 8/2015 |
| DE | 10 2020 116 858 | A1 | 1/2021 |
| EP | 0 812 926 | A1 | 12/1997 |
| JP | S56-163244 | A | 12/1981 |
| JP | S57-134544 | A | 8/1982 |
| JP | 2010-516902 | A | 5/2010 |
| WO | 2007/124996 | A1 | 11/2007 |
| WO | 2015/117584 | A1 | 8/2015 |
| WO | 2015/117585 | A2 | 8/2015 |

OTHER PUBLICATIONS

English translation of the International Preliminary Report on Patentability and Written Opinion of the International Searching Authority in PCT/DE2023/100283, mailed Nov. 7, 2024.

International Search Report in PCT/DE2023/100282, mailed Jul. 17, 2023.

International Search Report in PCT/DE2023/100283, mailed Jul. 14, 2023.

* cited by examiner

USE OF A NICKEL-IRON-CHROMIUM ALLOY HAVING HIGH RESISTANCE IN CARBURIZING AND SULFIDIZING AND CHLORINATING ENVIRONMENTS AND SIMULTANEOUSLY GOOD PROCESSABILITY AND STRENGTH

CROSS REFERENCE TO RELATED APPLICATIONS

This application is the National Stage of PCT/DE2023/100282 filed on Apr. 20, 2023, which claims priority under 35 U.S.C. § 119 of German Application No. 10 2022 110 383.8 filed on Apr. 28, 2022, the disclosure of which is incorporated by reference. The international application under PCT article 21(2) was not published in English.

The invention relates to the use of a nickel-iron-chromium-alloy with good high-temperature corrosion resistance in highly corrosive environments such as, for example, in environments that are simultaneously carburizing and sulfidizing and chlorinating, and with improved processability, especially weldability.

Austenitic nickel-iron-chromium alloys having different nickel, chromium and iron contents have long been used in furnace construction and in the chemical and petrochemical industry. For this service, a good high-temperature corrosion resistance even in carburizing, sulfidizing environments and a good hot strength are required.

In general, it must be pointed out that the high-temperature corrosion resistance of the alloys listed in Table 1 increases with increasing chromium content. All of these alloys form a chromium oxide layer ($Cr_2O_3$) with an underlying silicon oxide layer, which is more or less closed. Small additions of strongly oxygen-affine elements such as, for example, yttrium or cerium, improve the corrosion resistance. In the course of service in the area of application for establishment of the protective layer, the chromium content is slowly consumed. The useful life of the material is therefore prolonged by a higher chromium content, since a higher content of the element chromium, which forms the protective layer, delays the time at which the chromium content goes below the critical limit and oxides other than $Cr_2O_3$ are formed that are, for example, iron-containing and nickel-containing oxides. A further increase of the high-temperature corrosion resistance can be achieved by additions of silicon or aluminum. Starting from a certain minimum content, these elements form a closed layer underneath the chromium oxide layer and in this way reduce the consumption of chromium.

In carburizing environments (CO, $H_2$, $CH_4$, $CO_2$, $H_2O$ mixtures), carbon may penetrate into the material and thus lead to formation of internal carbides. These cause a loss of notch impact strength. Transformation processes due to depletion of chromium in the matrix may also occur.

A high resistance to carburization is attained by materials having low solubility for carbon and low carbon diffusion rate. Nickel alloys are therefore generally more resistant to carburization than iron-base alloys, since both the carbon diffusion and the carbon solubility in nickel are lower than in iron. An increase of the chromium content brings about a higher carburization resistance by formation of a protective chromium oxide layer, unless the oxygen partial pressure in the gas is not sufficient for formation of this protective chromium oxide layer. At very low oxygen partial pressures, materials may be used that form a layer of silicon oxide or of the even more stable aluminum oxide, both of which can form protective oxide layers even at much lower oxygen contents.

In carburizing, sulfidizing environments with low oxygen partial pressure (CO, $H_2$, $H_2O$, $CO_2$, $H_2S$ mixtures), sulfur may penetrate into the material and thus lead to formation of sulfides. The melting point may also sink to very low values (635° C. for the Ni—$Ni_3S_2$ eutectic, 988° C. for the Fe—FeS eutectic). In sulfidizing environments, nickel-iron-chromium with high nickel contents are often more sensitive than nickel-iron-chromium alloys with high iron content. Here also a further increase of the high-temperature corrosion resistance can be achieved by additions of silicon or aluminum.

In chlorinating environments with low oxygen partial pressure, volatile metal chlorides with high vapor pressures and/or low melting points may be formed and thus cause high corrosion rates. A high content of chromium and/or nickel improves the corrosion resistance.

In DE 41 30 139 C1, a heat-resisting, hot-formable austenitic nickel alloy is described that consists (in mass-%) of 0.05 to 0.15% carbon, 2.5 to 3.0% silicon, 0.2 to 0.5% manganese, max. 0.015% phosphorus, max. 0.005% sulfur, 25 to 30% chromium, 20 to 27% iron, 0.05 to 0.15% aluminum, 0.001 to 0.005% calcium, 0.05 to 0.15% rare earths, 0.05 to 0.20% nitrogen, with the rest nickel and the usual melting-related impurities.

The alloy described in DE 41 30 139 C1 is known by the designations "NiCr28FeSiCe", Alloy 45™, Nicrofer 45™ or under material number 2.4889, and in the following will be designated by "45™".

The alloy 45™ is very resistant in carburizing and sulfidizing media, which is why it is suitable for use in refuse-incineration plants or coal-gasification plants. FIG. 1 shows the metallographically measured corrosion attack depth in various alloys after exposure for 2100 hours in a PRENFLO coal-gasification pilot plant in Fürstenhausen to an $H_2S$-containing gas as a function of temperature for various alloys. Table 1 shows the composition of the investigated alloys according to the prior art. A high chromium and a high silicon content reduces the corrosion attack depth significantly. Due to the high silicon content of ≥2.5%, a silicon oxide layer that imparts the high corrosion resistance to the material can be formed underneath the protective chromium oxide layer. 45™ containing 26 to 29% chromium and 2.5 to 3% silicon exhibits the smallest corrosion attack depth at all temperatures, followed by AC66 containing 26 to 28% chromium and at most 0.3% silicon.

However, the alloy 45™ can be processed only with great difficulty. This is shown, for example, by crack formation during hot forming. 45™ likewise tends to crack formation during welding, which makes an intrinsic welding (using a weld filler in the same composition range as the material to be welded)—which would be logical for reasons of corrosion protection—impossible and makes the practical use of the material more difficult. For austenitic FeCrNi weld metals with primary austenite solidification, the formation of low-melting phases due to silicon enrichments at the austenite grain boundaries (Fe—$Fe_2Si$ eutectic: 1212° C.; NiSi—$Ni_3Si_2$ eutectic: 964° C. and NiSi eutectic: 996° C.) as well as the expanding solidification range are mentioned as the cause of the increased hot-crack formation.

In contrast, the alloy AC66 (see Table 1 for composition) has a sufficient weldability and processability, but is not very corrosion-resistant in a coal-gasification plant, as FIG. 1 shows.

The requirements applicable to the material become stricter when an attack by chlorine is added to the carburizing, sulfidizing conditions, just as occurs in coal-gasification plants, refuse-incineration plants, etc.

For materials used in carburizing, sulfidizing and chlorinating environments, especially atmospheres, a compromise must be reached with respect to the composition.

The hot strength is improved by a high carbon content among other possibilities. However, even high contents of solid-solution-strengthening elements such as chromium, aluminum, silicon, molybdenum and tungsten improve the hot strength.

U.S. Pat. No. 6,623,869 B1 describes a metal material that contains the following constituents in mass-%: not more than 0.2% carbon, 0.01-4% silicon, 0.05-2% manganese, not more than 0.04% phosphorus, not more than 0.015% sulfur, 10-35% chromium, 30-78% nickel, not less than 0.005% aluminum, but less than 4.5% aluminum, 0.005-0.2% nitrogen and one or both of 0.015-3% copper and 0.015-3% cobalt, wherein the rest is mainly iron. Therein the value of 40 Si+Ni+5 Al+40 N+10 (Cu+Co) is not less than 50, wherein the symbols of the elements denote the alloy content of the respective elements. The metal material has an excellent corrosion resistance in an environment in which metal dusting may occur and it can therefore be used in furnace tubes, piping plants, heat-exchanger tubes, etc. in a petroleum refinery or in petrochemical plants. The durability and safety of the plant can be significantly improved.

U.S. Pat. No. 3,833,358 A describes an iron-base fireproof alloy that offers high resistance to creep, thermal shock, thermal fatigue and intercrystalline oxidation, as well as good weldability and consists mainly of the following elements (in proportions by weight):

C 0.05-0.20
Ni 30-40
Cr 20-30
Nb 0.2-2
N 0.04-0.2
Mn 0.6-2
Si 0.6-2
Ta 0-0.3
Ti 0-1
Mo 0-0.5
Al 0-0.05
Pb 0-0.01
Sn 0-0.01
Zn 0-0.01
Cu 0-0.25 and the rest is mainly iron. In this case, the proportions by weight of the aforesaid elements fulfill the following formulas $$30*C\ \% + Ni\ \% + 0.5*Mn\ \% + 16*N\ \% = Cr\ \% + 0.5*(Nb + 1/2\ Ta)\% + 3.5*Ti\ \% + 1.5*Si\ \% + Mo\ \% + (11\ +/-\ 2)\%$$

$$A = B\ +/-\ 20\%$$

$$\text{with } A = 30*C\ \%\quad B = 2*Ti\ \% + 6*(Nb + 1/2\ Ta)\%.$$

U.S. Pat. No. 3,865,581 A describes a heat-resisting alloy having hot formability, containing 0.01 to 0.5% C, 0.01 to 2.0% Si, 0.01 to 3.0% Mn, 22 to 80% Ni and 10 to 40% Cr as main components together with one or both of 0.0005 to 0.20% B and 0.001 to 6.0% Zr and further one or more of 0.001 to 0.5% Ce, 0.001 to 0.2% Mg and 0.001 to 1.0% Be, the rest iron and unavoidable impurities. It is suitable for use in furnace construction (burner tips, protective housings, protective tubes for thermocouples, etc.).

DE 1024719 A describes a method for addition of cerium and/or lanthanum to a nickel-iron alloy. It relates to a hot-workable alloy, characterized by the following composition: 0 to 0.5% carbon, 10 to 60% of one or more of the elements chromium, molybdenum and tungsten, wherein the proportion of each individual one of these elements does not exceed 30%, 0 to 73% iron, 0.02 to 1.10% cerium or lanthanum or both, the rest being 4 to 70% nickel including impurities, with the proviso that the content of the rare earth metals is matched in the following way with the nickel content:

| % nickel | % cerium or lanthanum or both |
|---|---|
| 4 | approx. 0.02 to 1.10 |
| 10 | approx. 0.02 to 1.05 |
| 20 | approx. 0.02 to 0.90 |
| 30 | approx. 0.02 to 0.75 |
| 40 | approx. 0.02 to 0.60 |
| 50 | approx. 0.02 to 0.45 |
| 60 | approx. 0.02 to 0.30 |
| 70 | approx. 0.02 to 0.15 |

In EP 0 812 926 A1, a nickel-base alloy is described, the strength of which increases during use and which consists of 0.06-0.14% carbon, 35-46% nickel, 22.5-26.5% chromium, 0-1.5% manganese, 0.5-2% silicon, 0.1-1% titanium, 0.05-2% aluminum, 1-3% molybdenum, 0.2-1% niobium, 0.1-1% tantalum, 0-0.3% tungsten, 0-0.008% boron, 0-0.05% zirconium and the rest iron and incidental impurities.

WO 2007/124996 A1 describes a reaction vessel for the use in the manufacture of hydrogen sulfide by reaction between sulfur and hydrogen, wherein the reaction vessel and if applicable connecting lines as well as fittings and measuring and control devices consist partly or completely of an aluminum-containing material that is resistant to the reaction mixture. In particular, the material contains the constituents 0-0.3% C, 0-2.5% Si, 0-2.5% Mn, 0-0.1% P, 0-0.3% S, 15.0-28.0% Cr, 0-1.0% Cu, 0—the rest % Fe, 1.0-5.0% Al, 0-2.5% Co, 0-1.5% Ti, 0-0.4% Y as well as up to 70% Ni (% in wt-%).

DE 10 2007 005 605 A1 describes an iron-nickel-chromium-silicon alloy containing (in wt-%) 34 to 42% nickel, 18 to 26% chromium, 1.0 to 2.5% silicon and additions of 0.05 to 1% Al, 0.01 to 1% Mn, 0.01 to 0.26% lanthanum, 0.0005 to 0.05% magnesium, 0.01 to 0.14% carbon, 0.01 to 0.14% nitrogen, max. 0.01% sulfur, max. 0.005% boron, the rest iron and the usual process-related impurities. This alloy is used in heating elements.

U.S. Pat. No. 5,021,215 A discloses a high-strength, heat-resisting steel that has improved formability and consists mainly of (wt-%):

| | |
|---|---|
| C: 0.05-0.30%, | Si: not more than 3.0%, |
| Mn: not more than 10%, | Cr: 15-35%, |
| Ni: 15-50%, | Mg: 0.001-0.02%, |
| B: 0.001-0.01%, | Zr: 0.001-0.10%, |
| at least one element from Ti: 0.05-1.0%, | Nb: 0.1-2.0%, and |
| Al: 0.05-1.0%, | |
| Mo: 0-3.0%, | W: 0-6.0%, |

(Mo+½ W=3.0% or less)

the rest Fe and incidental impurities, wherein the impurities oxygen and nitrogen are limited to 50 ppm or less and respectively 200 ppm or less, and wherein the austenite grain size number is limited to no. 4 or coarser.

JPS 56163244 A describes the improvement of the hot workability and oxidation resistance of an austenitic steel by addition of a defined proportion of C, Si, Mn, Ni, Cr, Al, B, a rare earth element and Ca to the steel. This is achieved by an austenitic steel containing the following composition in wt-%: <0.2% C, 1.5-3.5% Si, <2% Mn, 8-35% Ni, 15-30% Cr, <2% Al, 0.0005-0.005% B, 0.005-0.1% of a rare earth element and 0.0005-0.02% Ca or additionally introduced 0.0005-0.03% Mg, if necessary. The austenitic steel obtained in this way is refined in a standard steelmaking furnace and this molten steel is formed to a billet, which is then hot-rolled.

U.S. Pat. No. 7,118,636 B2 describes a nickel-iron-chromium alloy that contains a strengthening phase, which is able to retain a fine grain structure during forging and during processing of the alloy at high temperatures. The alloy contains a sufficient proportion of titanium, zirconium, carbon and nitrogen that fine titanium and zirconium nitrides are formed, even though these are close to their solubility limit in the molten state of the alloy. In the manufacture of an article from such an alloy by thermomechanical working, a dispersion of the fine titanium and zirconium carbonitride precipitates is formed during solidification of the melt and remains in the alloy during subsequent processing steps (at high temperatures), thus inhibiting austenitic grain growth. The nickel-iron-chromium alloy contains less than 0.05 wt-% niobium, at least 0.05% zirconium, at least 0.05% carbon, at least 0.05% nitrogen, a carbon-to-nitrogen weight ratio of at least 1 to 2 up to less than 1 to 1, sufficient titanium, zirconium and/or aluminum to be free of chromium carbides, and titanium, zirconium, carbon and nitrogen in sufficient proportions to form a uniform dispersion of fine titanium and zirconium carbonitrides to obtain $[(Ti_xZr_{1-x})(C_yN_{1-y})]$ in a sufficient proportion close to the solubility limit of the titanium and zirconium carbonitride precipitates in a molten state of the alloy. Moreover, this nickel-iron-chromium alloy consists of approx. 32 wt-% to approx. 38 wt-% iron, approx. 22 wt-% to 28% chromium, approx. 0.10% to approx. 0.60% titanium, approx. 0.05% to approx. 0.30% zirconium, approx. 0.05% to approx. 0.30% carbon, approx. 0.05% to approx. 0.30% nitrogen, approx. 0.05% to approx. 0.5% aluminum, up to 0.99% molybdenum, up to approx. 0.01% boron, up to approx. 1% silicon, up to approx. 1% manganese, the rest nickel and incidental impurities.

JPS 57134544 A describes the improvement of the resistance to stress corrosion cracking of oil drilling pipes by addition of specified proportions of Mo, W, etc. to a high Cr—Ni-containing steel as material for pipes. In this case an alloyed steel is used that has a composition of <0.10% C, <1.0% Si, <2.0% Mn, <0.030% P, <0.005% S, <0.5% Al, 22.5-30% Cr, 25-60% Ni and Mo and/or W and that satisfies the equations $$Cr(\%) + 10 * Mo(\%) + 5 * W(\%) \geq 70\%$$

$$4\% \leq Mo(\%) + 1/2\ W(\%) < 8\%$$

The steel is used for a pipe for an oil borehole drilled in the highly corrosive, harsh environment of an oil source, a natural gas source, etc. It is possible to add to the alloy <1% Cu and/or <2% Co and/or <0.10% of one or more among the rare earth elements, <0.20% Y, <0.10% Mg, <0.10% Ca and <0.5% Ti. Pipes can be manufactured for oil boreholes with superior stress corrosion cracking resistance in the highly corrosive environment of an oil source containing $H_2S$, $CO_2$ and Cl.

The task underlying the invention therefore consists in designing the use of a nickel-iron-chromium wrought alloy that a) has a good high-temperature corrosion resistance in a highly corrosive environment such as, for example, in environments that are simultaneously carburizing and sulfidizing and chlorinating, comparable with that of the alloy 45™, b) has a sufficient processability, especially weldability, as comparable as possible to that of the alloy AC66, and c) has a sufficient hot strength at 500° C., similar to that of the alloy AC66.

The task underlying this invention is accomplished by the use, as semifinished product, of a nickel-iron-chromium-alloy with excellent high-temperature corrosion resistance in environments that are simultaneously carburizing, sulfidizing and chlorinating, the said alloy containing (in mass-%):

35.0 to 38% nickel,
26.0 to 30.0% chromium,
>0.7 to 1.50% silicon,
0.40 to 1.30% aluminum,
0.00 to 1.0% manganese,
respectively 0.0001 to 0.05% magnesium and/or calcium,
0.015 to 0.12% carbon,
0.001 to 0.150% nitrogen,
0.001 to 0.030% phosphorus,
0.0001 to 0.020% oxygen,
at most 0.010% sulfur,
less than 1.0% molybdenum,
less than 1.0% cobalt,
less than 0.5% copper,
less than 1.0% tungsten,
the rest iron and the usual process-related impurities, wherein
the following relationship must be satisfied:

$$Fc = -1.2 + 0.29 * Ni - 4.6 * Si - 4.4 * Al \leq 2.5, \quad (1a)$$

wherein Ni, Si and Al are the concentrations of the elements in question in mass-%.

Advantageous further developments of the subject matter of the invention can be inferred from the associated dependent claims.

The nickel content lies between 35.0 and 38.0%, wherein preferred contents may be adjusted within the following ranges of values:

35 or >35.0 to <38.0%
35 or >35.0 to 37 or <37.0%.

The range of values for the element chromium lies between 26.0 and 30.0%, wherein preferred ranges may be adjusted as follows:

>26.0 to <30.0%
27.0 or >27.0 to 30.0 or <30.0%
28.0 or >28.0 to 30.0 or <30.0%

The silicon content lies between >0.7 and 1.50%, Preferably, silicon can be adjusted within the range of values as follows in the alloy:

>0.70 to <1.50%.
0.80 or >0.80 to 1.50 or <1.50%
0.90 or >0.90 to 1.50 or <1.50%

0.80 or >0.80 to 1.50 or <1.50%
0.80 or >0.80 to 1.45 or <1.45%.

The aluminum content lies between 0.40 and 1.30%, wherein, here also, preferred aluminum contents may be specified as follows:

>0.40 to <1.30%
0.50 or >0.50 to 1.30 or <1.30%
0.50 or >0.50 to 1.20 or <1.20%
0.50 or >0.50 to 1.10 or <1.10%
0.60 or >0.60 to 1.10 or <1.10%.

The same is true for the element manganese, which may be present in proportions of 0.0 to 1.0% in the alloy. Alternatively, the following range of values is also conceivable:

>0.0 to <1.00%
>0.0 to 0.50 or <0.50%>
0.0 to 0.05 or <0.05%
0.005 or >0.005 to 0.20 or <0.20%
0.005 or >0.005 to 0.10 or <0.10%.

Magnesium and/or calcium is also present in contents of 0.0001 to 0.05%. Preferably, the possibility exists of adjusting these elements as follows in the alloy:

0.0001 to 0.030%
0.0001 to 0.020%
0.0002 to 0.015%
0.0010 to 0.010%.

The alloy contains 0.015 to 0.12% carbon. Preferably, this may be adjusted within the range of values as follows in the alloy:

>0.015 to <0.12%.
0.03 or >0.03 to 0.10 or <0.10%
0.04 or >0.04 to 0.10 or <0.10%
0.05 or >0.05 to 0.10 or <0.10%
0.05 or >0.05 to 0.09 or <0.09%.

This is true in the same way for the element nitrogen, which is present in contents between 0.001 and 0.150%. Preferred contents may be specified as follows:

>0.001 to <0.150%
0.010 or >0.010 to 0.140 or <0.140%
0.020 or >0.020 to 0.140 or <0.140%
0.050 or >0.050 to 0.140 or <0.140%.

Furthermore, the alloy contains phosphorus in contents between 0.001 and 0.030%. Preferred contents may be specified as follows:

0.001 to 0.015%.

Furthermore, the alloy contains oxygen in contents between 0.0001 and 0.020%, especially 0.0001 to 0.010%.

The element sulfur is present to at most 0.010% in the alloy. Preferred contents may be specified as follows:

sulfur max. 0.008%.

Molybdenum is present with a content of less than 1.0% in the alloy. Beyond this, the molybdenum content may be limited as follows:

MO max. 0.50 or <0.50%
Mo max. 0.20 or <0.20%
Mo max. 0.10 or <0.10%
Mo max. 0.05 or <0.05%
Mo max. 0.02 or <0.02%.

Furthermore, less than 1.0% cobalt is present in the alloy. Beyond this, the cobalt content may be limited as follows:

Co max. 0.50 or <0.50%
Co max. 0.20 or <0.20%
Co max. 0.10 or <0.10%
Co max. 0.05 or <0.05%
Co max. 0.015 or <0.015%.

Furthermore, less than 0.5% copper may be present in the alloy. Beyond this, the content of copper may be limited as follows:

Cu max. 0.30 or <0.30%
Cu max. 0.10 or <0.10%
Cu max. 0.05 or <0.05%
Cu max. 0.015 or <0.015%.

Tungsten is present in the alloy with a content of at most 1.0%.

Beyond this, the tungsten content may be limited as follows:

W <1.0%
W max. 0.50 or <0.50%
W max. 0.20 or <0.20%
W max. 0.10 or <0.10%
W max. 0.05 or <0.05%
W max. 0.02 or <0.02%.

The rest in the alloy consists of iron and the usual manufacturing-related impurities. Beyond this, the iron content may be limited as follows:

28.0 or >28.0 to 38.0%
29.0 or >29.0 to 38.0%
30.0 or >30.0 to 38.0 or <38.0%.

The following relationship between nickel, silicon and aluminum must be satisfied to ensure that a sufficient resistance exists in carburizing and sulfidizing and chlorinating environments.

$$Fc = -1.2 + 0.29 * \mathrm{Ni} - 4.6 * \mathrm{Si} - 4.4 * \mathrm{Al} \leq 2.5, \quad (1a)$$

wherein Ni, Si and Al and Si are the concentrations of the elements in question in mass-%.

Preferred ranges may be adjusted as follows:

$$Fc = -1.2 + 0.29 * \mathrm{Ni} - 4.6 * \mathrm{Si} - 4.4 * \mathrm{Al} \leq 1.5 \quad (1b)$$

$$Fc = -1.2 + 0.29 * \mathrm{Ni} - 4.6 * \mathrm{Si} - 4.4 * \mathrm{Al} \leq 1.0 \quad (1c)$$

Additions of oxygen-affine elements such as cerium, lanthanum, yttrium, zirconium and hafnium improve the corrosion resistance. They do this by being incorporated in the oxide layer, where they block the paths of diffusion of the oxygen to the grain boundaries.

If necessary, the alloy may contain 0.001 to 0.20% respectively of one or more of the elements cerium, lanthanum, yttrium, zirconium and hafnium, wherein the following formula must be satisfied:

$$FRE = 0.714 * \mathrm{Ce} + 0.720 * \mathrm{La} + 1.124 * \mathrm{Y} + 1.096 * \mathrm{Zr} + 0.560 * \mathrm{Hf} \leq 0.10 \quad (2a)$$

wherein Ce, La, Y, Zr and Hf are the concentrations of the elements in question in mass-%.

Preferably, FRE may be adjusted as follows if at least one of the elements cerium, lanthanum, yttrium, zirconium and hafnium is present $$FRE = 0.714 * \mathrm{Ce} + 0.720 * \mathrm{La} + 1.124 * \mathrm{Y} + 1.096 * \mathrm{Zr} + 0.560 * \mathrm{Hf} \leq \quad (2b)$$

-continued $$FRE = 0.714 * Ce + 0.720 * La + 1.124 * Y + 1.096 * Zr + 0.560 * Hf \leq 0.075 \quad (2c)$$

$$0.065$$

Optionally, in case of simultaneous presence of cerium and lanthanum, cerium mixed metal (abbreviation CeMM) may also be used in contents of 0.001 to 0.20%, wherein FRE must be modified as follows:

$$FRE = 0.716 * CeMM + 1.124 * Y + 1.096 * Zr + 0.560 * Hf \leq 0.10 \quad (3a)$$

wherein CeMM, Y, Zr and Hf are the concentrations of the elements in question in mass-%.

Preferably, FRE may be adjusted as follows in case of addition of cerium mixed metal:

$$FRE = 0.716 * CeMM + 1.124 * Y + 1.096 * Zr + 0.560 * Hf \leq 0.075 \quad (3b)$$

$$FRE = 0.716 * CeMM + 1.124 * Y + 1.096 * Zr + 0.560 * Hf \leq 0.065 \quad (3c)$$

Preferably, cerium, lanthanum, cerium mixed metal zirconium and hafnium may be present within the range of values as follows in the alloy:

>0.001 to <0.20%
0.001 or >0.001 to 0.15 or <0.15%
0.001 or >0.001 to 0.10 or <0.10%
0.001 or >0.001 to 0.08 or <0.08%
0.001 or >0.001 to 0.05 or <0.05%
0.001 or >0.001 to 0.04 or <0.04%.
0.01 or >0.01 to 0.04 or <0.04%

Preferably, yttrium may be present within the range of values as follows in the alloy:

>0.001 to <0.20%
0.001 or >0.001 to 0.15 or <0.15%
0.001 or >0.001 to 0.10 or <0.10%
0.001 or >0.001 to 0.08 or <0.08%
0.01 or >0.01 to 0.08 or <0.08%
0.01 or >0.01 to <0.045%.

Optionally, the element titanium may be present in contents of 0.0 to 0.50% in the alloy. Preferably, titanium may be present within the range of values as follows in the alloy:

>0.0 to <0.50%>
0.0 to 0.50 or <0.50%
0.001 or >0.001 to 0.20 or <0.20%
0.001 or >0.001 to 0.15 or <0.15%
0.001 or >0.001 to 0.10 or <0.10%
0.001 or >0.001 to 0.05 or <0.05%
0.001 or >0.001 to 0.04 or <0.04%.
0.005 or >0.005 to 0.20 or <0.20%.
0.010 or >0.010 to 0.20 or <0.20%.

Optionally, the element niobium may be adjusted to contents of 0.0 to 0.2% in the alloy. Preferably, niobium may be present within the range of values as follows in the alloy:

>0.0 to <0.20%
>0.0 to 0.15 or <0.15%
>0.0 to 0.10 or <0.10%
>0.0 to 0.05 or <0.05%
>0.0 to 0.02 or <0.02%
0.001 or >0.001 to 0.20 or <0.20%
0.010 or >0.010 to 0.20 or <0.20%.

Optionally, 0.0 to 0.20% tantalum may also be present in the allow. Preferred contents may be specified as follows:

>0.0 to <0.20%
>0.0 to 0.10 or <0.10%
>0.0 to 0.05 or <0.05%.

Optionally, the element boron may be present in contents of 0.0001-0.008% in the alloy. Preferred contents may be specified as follows:

Boron 0.0005-0.008%
Boron 0.0005-0.005%
Boron 0.0005-0.004%.

Furthermore, at most 0.50% vanadium may be present in the alloy.

V<0.50%
V max. 0.40 or <0.50%
V max. 0.20 or <0.20%
V max. 0.08 or <0.10%
V max. 0.05 or <0.05%

Finally, as impurities, the elements lead, zinc and tin may also be specified in contents as follows:

Pb max. 0.002%, Zn max. 0.002%, Sn max. 0.002%

Then the element beryllium may be specified as follows:

Be less than 0.001%,

The alloy according to the invention is preferably melted openly, followed by a VOD (vacuum oxygen decarburization) or VLF (Vacuum Ladle Furnace) treatment. However, a melting and casting in vacuum is also possible. Thereafter the alloy is cast in ingots, electrodes or as a continuous casting for formation of a precursor product. If applicable, the precursor product is then annealed at temperatures between 900 and 1270° C. for 0.1 hours to 70 hours. Furthermore, it is possible to remelt the alloy additionally one or more times with ESR (Electroslag Remelting) and/or VAR (Vacuum Arc Remelting). Then the alloy is introduced into the desired semifinished product mold. For this purpose, annealing is carried out if necessary at temperatures between 800° C. and 1290° C. for 0.1 hours to 70 hours, followed by hot-forming, if necessary with intermediate annealings between 800° C. and 1290° C. for 0.05 hours to 70 hours. The surface of the material may if necessary be chemically and/or mechanically stripped for cleaning intermediately (even several times) and/or at the end of the hot forming. Thereafter a cold forming with reduction ratios up to 98% may be carried out if necessary in the desired semifinished product mold, if necessary with intermediate annealings between 800° C. and 1250° C. for 0.05 minutes to 70 hours, if necessary under shield gas, such as, for example, argon or hydrogen, followed by a cooling in air, in the agitated annealing atmosphere or in the water bath. Thereafter a solution annealing is carried out in the temperature range from 800° C. to 1250° C. for 0.05 minutes to 70 hours, if necessary under shield gas, such as, for example, argon or hydrogen, followed by a cooling in air, in the agitated annealing atmosphere or in the water bath. If necessary, chemical and/or mechanical cleanings of the material surface may be carried out intermediately and/or after the last annealing.

The semifinished product manufactured by hot and or cold rolling has, after solution annealing, a microstructure with a mean grain size of 5 to 600 μm.

The alloy according to the invention can be manufactured and used well in the semifinished product forms of rod, sheet, forging, longitudinally welded tube or seamless tube, pipe accessories, valve part, flanges. The various semifinished product forms may be built into the needed components or installed in the needed components.

Similarly, the alloy according to the invention may be used if necessary for the build-up welding on metallic components of any type.

The alloy according to the invention is suitable in particular as a component for service areas with carburizing and sulfidizing and chlorinating environments, especially atmospheres. By virtue of its good high-temperature corrosion resistance and its good formability and weldability, the alloy according to the invention is suitable for service as a component in refuse-incineration plants, in pyrolysis plants, in refinery furnaces, in the chemical industry, in coal-gasification plants and in industrial furnace construction, for active carbon filters, refuse pyrolysis and recovery of precious metals.

EXAMPLES

Tests Performed

The assessment of the high-temperature corrosion resistance in carburizing and sulfidizing and chlorinating environments was made via the resistance of the material in a flowing synthetic gas atmosphere having these properties at high temperatures (at the Dechema).

For this purpose, specimens with the dimension of 20×8×4 $mm^3$ were cut out of the semifinished product of the respective alloys, then provided with a bore of 3 mm and thereafter wet-ground with SiC paper to 1200 grit (grain size ~15 μm). The specimens were degreased and cleaned in an ultrasonic bath containing isopropanol. By means of this bore, each specimen was suspended in the reaction vessel above a ceramic crucible, so that any spalled corrosion products were captured and that the mass of the spallings can be determined by weighing the crucible containing the corrosion products. The sum of the mass of the spallings and of the change in mass of the specimens is the gross change in mass of the specimen. The specific change in mass is the change in mass relative to the surface area of the specimens. These are denoted in the following as mnet for the specific net change in mass, mgross for the specific gross change in mass, mspall for the specific change in mass of the spalled oxides.

A gas mixture of 60% CO, 30% $H_2$, 4% $CO_2$, 1% $H_2S$, 0.05% HCl and 3.95% $H_2O$ was passed through the space of the reaction vessel. This mixture has a carburizing (60% CO), sulfidizing (1% $H_2S$) and chlorinating (0.05% HCl) action. Tests were performed at 500° C. The test duration was respectively 1056 hours, divided into 11 cycles of 96 hours each. Two specimens per alloy were exposed in each test. The indicated values are the mean values of these two specimens.

In the following investigation, an alloy is deemed to be resistant in carburizing and sulfidizing and chlorinating environments if after 1056 hours it exhibits $$\text{a gross increase in mass of} \leq 2.0\ \text{mg/cm}^2 \tag{4}$$

This is the case when the following relationship between nickel, silicon and aluminum is satisfied:

$$Fc = -1.2 + 0.29 * \text{Ni} - 4.6 * \text{Si} - 4.4 * \text{Al} \leq 2.5, \tag{1a}$$

wherein Ni, Si and Al and Si are the concentrations of the elements in question in mass-%.

The assessment of the weldability is made via the extent of formation of hot cracks during welding. The greater the danger of hot-crack formation, the poorer is the weldability of a material.

For quantification of the susceptibility to hot cracks, the various alloys were tested with the MVT (Modified Varestraint Transvarestraint) test at the BAM (German Federal Institute for Materials Research and Testing). For this purpose, a specimen with the dimensions of 100 mm×40 mm×10 mm was made from the alloy. In the MVT test, a TIG weld (TIG: Tungsten Inert Gas) is made fully mechanically with constant feed speed longitudinally on the upper side of this specimen. When the arc passes the middle of the specimen, a defined bending strain is applied to the specimen. For this purpose, the specimens are bent longitudinally relative to the welding direction (Varestraint mode). In this phase of the bending, hot cracks are formed in a locally limited test zone on the MVT specimen.

The tests were performed with 4% bending strain, a die speed of 2 mm/s, with an energy per unit length of 7.5 kJ/cm, respectively under pure argon 4.8.

For the evaluation, the lengths of all solidification cracks and remelting cracks that are visible on the specimen in an optical microscope at 25× magnification are determined and summed. On the basis of these results, the material may then be classified into the category "hot-cracking safe" (range 1), "increasing hot-cracking tendency" (range 2) and "at risk of hot cracking" (range 3) as shown in Table 2.

In the following investigations, the alloys lying in range 1 "hot-cracking safe" and in range 2 "increasing hot-cracking tendency" in the MVT test are deemed to be acceptably weldable, since alloy AC66, which is weldable according to the prior art, lies in range 2. Alloys that lie in the at risk of hot cracking (range 3) are usually difficult to weld. In particular, welding with an intrinsic weld filler (having a composition comparable with that of the material to be welded) is more difficult or impossible.

The assessment of the hot strength was determined by hot tension tests. This is determined in a tension test according to DIN EN ISO 6892-2 at the desired temperature. In the process, the offset yield strength $Rp_{0.2}$, the tensile strength $R_m$ and the elongation to break A are determined. The tests were performed on round specimens with a diameter of 6 mm in the measurement region and a starting gauge length $L_0$ of 30 mm. The offset yield strength $Rp_{0.2}$ or the tensile strength $R_m$ at 500° C. should attain at least the minimum values for the alloy AC66 according to the prior art:

$$500\ °\text{C}: Rp0.2 \geq 95\ \text{MPa or } Rm \geq 115\ \text{MPa} \tag{5a, 5b}$$

It would be desirable for them to be better than the minimum values of the alloy 45™ according to the prior art.

$$500\ °\text{C}\ Rp0.2 \geq 150\ \text{MPa or } Rm \geq 500\ \text{MPa}. \tag{6a, 6b}$$

The grain size is determined by means of a linear intercept method.

Manufacture

For establishment of the properties of the components that are manufactured from the alloy, alloys melted on the laboratory scale in a vacuum furnace were used.

Tables 3a and 3b show the analyses of the batches melted on the laboratory scale together with, for comparison, some batches of AC66 (1.4877) and 45™ (2.4889) melted on the industrial scale according to the prior art. The batches according to the prior art are identified with a T and those according to the invention with an E. The batches melted on the laboratory scale are marked with an L, the batches melted on the industrial scale with a G.

The ingots of the alloys in Table 3a and 3b, melted on the laboratory scale in vacuum, were annealed between 900° C. and 1270° C. for 8 hours and hot-rolled to a final thickness of 13 mm and 6 mm by means of hot rolling and further intermediate annealings between 900° C. and 1270° C. for 0.1 to 1 hours. The sheets produced in this way were solution-annealed between 800° C. and 1250° C. for 1 hour. The specimens needed for the measurements were manufactured from these sheets.

For the alloys melted on the industrial scale, a sample was taken from the industrial-scale fabrication of a commercially fabricated sheet having appropriate thickness. The specimens needed for the measurements were manufactured from these sheets.

All alloy variants typically had a grain size of 50 to 190 μm.

For the exemplary batches in Table 3a and b), the following properties are compared:

the high-temperature corrosion resistance in carburizing and sulfidizing and chlorinating environment the weldability by means of MVT tests the creep resistance by means of hot tension tests The summary of the results is presented in Table 4.

Table 4 shows the results of the corrosion tests in the form of gross change in weight and spallings at 500° C. after 1056 hours in an atmosphere of 60% CO, 30% $H_2$, 4% $CO_2$, 1% $H_2S$, 0.05% HCl and 3.95% $H_2O$. All tested alloys have a chromium content of approximately 27 to 28%. The alloy AC66 according to the prior art with only 0.2% silicon exhibits by far the largest gross change in mass of 10.92 mg/cm$^2$. The alloy 45™ according to the prior art, with 2.6% silicon, and all tested batches melted on the laboratory scale and having a silicon content higher than 1.0%, exhibit a gross change in mass of smaller than or equal to 2.0 mg/cm$^2$ (2209, 250098, 250101, 250105, 250102 and 250107). If, additionally, the aluminum content is greater than 0.40%, a batch with a silicon content lower than or equal to 1.0% may also have a gross change in mass smaller than or equal to 2.0 mg/cm$^2$, if simultaneously the formula (1a) Fc≤2.5 is satisfied. This is the case for batches 250084 (Si=0.59% and Al=0.95%), 250085 (Si=0.90% and Al 0.98%), 250106 (Si=0.98% and Al 0.80%) and 250108 (Si=0.70% and Al=0.86%).

Batches 250084, 250106, 250105, 250108 and 250107 are in accordance with the invention, while batch 2209 with a silicon content of higher than 1.50% and batch 250098 with a nickel content of 44.0% are not. Batch 250098 (Si=1.20% and Al=0.85%) exhibits, in comparison to batches 250106 (Si=0.98% and Al=0.80%) and 250101 (Si=1.01% and Al=0.75%), a comparable or larger gross increase in mass, despite a significantly increased silicon content of 1.2%. Batch 250098 (Ni=44.0%) has a significantly increased nickel content in comparison to batches 250106 (Ni=35.6%) and 250101 (Ni=38.2%). This shows that a higher nickel content worsens the corrosion. The upper limit for nickel is therefore set at a maximum of 40%.

In batch 250100 (Ni=38.2%, Si=0.99% and Al=0.43%), which is not in accordance with the invention and has an gross increase in mass (3.43 mg/cm$^2$) of significantly greater than 2.0 mg/cm$^2$, the aluminum content is somewhat too low, so that formula (1a) is not satisfied, in contrast to batch 250101 (Ni=38.2%, Si=1.01% and Al=0.75%). In batches 250103 (Ni=38.2, Si=0.36% and Al=0.82%) and 250099 (Ni=38.4%, Si=1.00% and Al=0.20%), which are not in accordance with the invention and likewise have a gross increase in mass (8.01 mg/cm$^2$ and 5.35 mg/cm$^2$ respectively) of significantly greater than 2.0 mg/cm$^2$, the silicon and the aluminum contents are outside the claimed limits and in addition formula (1a) is not satisfied.

The alloys 250084, 250106 according to the invention also exhibit spalling. If, in addition, formula (1c) Fc≤1.0 is satisfied, these alloys no longer exhibit any spalling (250107) and moreover surprisingly have, at moderate silicon contents, a very low gross change in mass of significantly smaller than 1.0 mg/cm$^2$, which is on the order of magnitude of 45™ with 2.6% silicon and 0.16% aluminum.

Table 4 shows the classification of the weldability of the alloys by means of the MVT test. The weldable alloy AC66 according to the prior art is in range 2. The alloy 45™ is classified in range 3 (at risk of hot cracking) and thus tends strongly to crack formation, which makes the welding difficult and welding with an intrinsic weld filler more difficult or impossible.

Batches that are not in accordance with the invention and have a silicon content higher than or equal to 1.50% (45™, batches 2091, 2099, 2100, 2200, 2203, 2207, 2208, 2209) all lie in range 3. Among the batches with a silicon content around 1.4%, the batches with an aluminum content lower than 0.1% lie in range 2 (batches 2093, 2101), while those with a higher aluminum content already lie in range 3 (batches 2103, 2096, 2097, 2098). The batches with a silicon content lower than 1.3% all lie in range 1 or 2 1 or 2 (AC66, batches 2095, 2102, 250084 to 250108). All laboratory batches according to the invention lie in range 1 (batches 250084, 250106, 250105, 250108 and 250107) or range 2 (batch 250102).

The results of the hot tension tests at 500° C. in Table 4 show that, in all alloys melted on the laboratory scale, the offset yield strength $R_{p0.2}$ is greater than or equal to 153 MPA and thus they significantly exceed the minimum of 95 MPa of AC66. They also exceed even the minimum of 45™ of 150 MPa, albeit not significantly (See formula 5a and 6a). Similarly, the tensile strength $R_m$ of all alloys according to the invention is greater than or equal to 192 MPa and thus likewise significantly greater than the minimum of 115 MPa of AC66 (see formula 5b). All hot tension tests at 500° C. had an elongation of greater than 35%.

The claimed limits for the alloys "E" according to the invention can therefore be justified individually as follows:

A relatively low nickel content (with simultaneously higher iron content (the rest)) favors a lesser corrosion in carburizing and sulfidizing and chlorinating environments. Therefore a content of 40% is the upper limit for nickel. A too low nickel content (simultaneously too high iron content (the rest)) favors formation of the sigma phase, especially at high chromium content and silicon content. Therefore a nickel content of 35% is the lower limit.

Chromium improves the corrosion resistance in carburizing and sulfidizing and chlorinating environments. Too low chromium contents mean that the chromium concentration during use of the alloy in a highly corrosive environment decreases very rapidly below the critical limit, so that a closed chromium oxide can no longer be formed. Therefore 26% chromium is the lower limit for chromium in the case of use in carburizing and sulfidizing and chlorinating environments. Too high chromium contents promote the formation of the sigma phase of the alloy, especially at high chromium contents. Therefore 30% chromium is to be regarded as the upper limit.

Silicon improves the corrosion resistance in carburizing and sulfidizing and chlorinating environments. A minimum content of 0.40% is therefore necessary. Too high contents in turn impair the weldability and promote the formation of sigma phase, especially at high chromium contents. The silicon content is therefore limited to 1.50%.

A certain content of aluminum improves the corrosion resistance in carburizing and sulfidizing and chlorinating environments. A minimum content of 0.40% is therefore necessary. Too high contents in turn impair the weldability, especially at high chromium and silicon contents. The aluminum content is therefore limited to 1.30%.

Manganese is useful for improvement of the processability. Manganese is limited to 1.0%, since this element reduces the high-temperature corrosion resistance.

Even very low magnesium contents and/or calcium contents improve the processing by the binding of sulfur, whereby the occurrence of low-melting NiS eutectics is avoided. For magnesium and/or calcium, therefore, a minimum content of 0.0001% is necessary. At too high contents, intermetallic Ni—Mg phases or Ni—Ca phases may occur, which again greatly worsen the processability. The magnesium and/or calcium content is therefore limited to at most 0.05%.

A minimum content of 0.015% carbon is necessary for a good creep resistance. Carbon is limited to at most 0.12%, since above such a content this element reduces the processability by the excessive formation of primary carbides.

A minimum content of 0.001% nitrogen is necessary, whereby the processability and the hot strength of the material are improved. Nitrogen is limited to at most 0.150%, since this element reduces the processability due to the formation of coarse carbonitrides.

The content of phosphorus should be lower than or equal to 0.030%, since this surface-active element impairs the high-temperature corrosion resistance. A too low phosphorus content increases the costs. The phosphorus content is therefore ≥0.001%.

The oxygen content must be lower than or equal to 0.020%, in order to ensure the manufacturability of the alloy. A too low oxygen content increases the costs. The oxygen content is therefore ≥0.0001%.

The contents of sulfur should be adjusted as low as possible, since this surface-active element impairs the high-temperature corrosion resistance. Therefore max. 0.010% sulfur is specified.

Molybdenum is limited to lower than 1.0%, since this element reduces the high-temperature corrosion resistance.

Tungsten is limited to lower than 1.0%, since this element likewise reduces the high-temperature corrosion resistance.

Cobalt may be present in a content lower than 1.0% in this alloy. Higher contents reduce the high-temperature corrosion resistance.

Copper is limited to lower than 0.5%, since this element reduces the high-temperature corrosion resistance.

The following relationship between nickel, silicon and aluminum must be satisfied to ensure that a sufficient resistance exists in carburizing and sulfidizing and chlorinating environments.

$$Fc = -1.2 + 0.29 * \mathrm{Ni} - 4.6 * \mathrm{Si} - 4.4 * \mathrm{Al} \leq 2.5, \quad (1a)$$

wherein Ni, Si and Al and Si are the concentrations of the elements in question in mass-%. The limit for Fc has been justified in detail in the foregoing text.

If necessary, the high-temperature corrosion resistance may be further improved with additions of oxygen-affine elements. They do this by being incorporated in the oxide layer, where they block the paths of diffusion of the oxygen to the grain boundaries.

For one or more of the elements cerium, lanthanum, cerium mixed metal, yttrium, zirconium and hafnium, a minimum content of respectively 0.001% is necessary to obtain the effect that increases the high-temperature corrosion resistance. For cost reasons, the upper limit for the respective element is set to 0.20%. In this case, the following formula must be satisfied:

$$FRE = 0.714 * \mathrm{Ce} + 0.720 * \mathrm{La} + 1.124 * \mathrm{Y} + 1.096 * \mathrm{Zr} + 0.560 * \mathrm{Hf} \leq 0.10 \quad (2a)$$

wherein Ce, La, Y, Zr, and Hf are the concentrations of the elements in question in mass-%. The total content of elements such as cerium, lanthanum, yttrium, zirconium and hafnium is limited by this formula. Contents with FRE>1.0 may increase the corrosion rates once again and impair the processability.

If necessary, titanium may be added. Titanium increases the high-temperature strength. At 0.50% and above, the high-temperature corrosion behavior may be impaired, which is why 0.50% is the maximum value.

If necessary, niobium may be added, since niobium also increases the high-temperature strength. Higher contents very greatly increase the costs. The upper limit is therefore set at 0.20%.

If necessary, the alloy may also contain tantalum, since tantalum also increases the high-temperature strength. Higher contents very greatly increase the costs. The upper limit is therefore set at 0.20%. A minimum content of 0.001% is necessary in order to achieve an effect.

If necessary, boron may be added to the alloy, since boron improves the creep resistance. Therefore a content of at least 0.0001% should be present. At the same time, this surface-active element worsens the high-temperature corrosion resistance. Therefore at most 0.008% boron is specified.

If necessary, vanadium is limited to at most 0.50%, since this element reduces the high-temperature corrosion resistance.

If necessary, lead is limited to at most 0.002%, since this element reduces the high-temperature corrosion resistance. The same is true for zinc and tin.

TABLE 1

Compositions of alloys according to the prior art according to EN or UNS*), all values in mass-%.

| Alloy name | EN or UNS material no. | C | Si | Mn | P | S | Cr | Ni | N | Al | Cu | Co | Ce | Fe | Others |
|---|---|---|---|---|---|---|---|---|---|---|---|---|---|---|---|
| 800H | 1.4876 | Max. 0.12 | Max. 1.0 | Max. 2.0 | Max. 0.03 | Max. 0.015 | 19-23 | 30-34 | Max. 0.03 | 0.15-0.6 | — | Max. 0.5 | | Rest | 0.15-0.6 Ti |
| 800LC | 1.4558 | Max. 0.03 | Max. 0.70 | Max. 1.0 | Max. 0.02 | Max. 0.015 | 20-23 | 32-34 | — | 0.15-0.45 | — | — | — | Rest | 8*(C + N) ≤ Ti ≤ 0.6 |
| 310 | S31000*) | Max. 0.25 | Max. 1.5 | Max. 2.0 | Max. 0.045 | Max. 0.03 | 24-26 | 19-22 | — | — | — | — | — | Rest | |
| 28 | 1.4563 | Max. 0.02 | Max 0.7 | Max. 2.0 | Max. 0.03 | Max. 0.01 | 26-28 | 30-32 | Max. 0.11 | — | 0.7-1.5 | — | — | Rest | 3.0-4.0 Mo |
| AC66 | 1.4877 | 0.04-0.08 | Max. 0.3 | Max. 1.0 | Max. 0.02 | Max. 0.01 | 26-28 | 31-33 | Max. 0.11 | Max. 0.25 | — | — | 0.05-0.10 | Rest | 0.6-1.0 Nb |
| 45TM | 2.4889 | 0.05-0.12 | 2.5-3.0 | Max. 1.0 | Max. 0.02 | Max. 0.01 | 26-29 | Min. 45 | — | — | Max. 0.3 | Max. 1.5 | 0.03-0.09 | 21-25 | |

*)Unified Numbering System for Metals and Alloys

TABLE 2

Classification of the weldability according to the total length of solidification and remelting cracks in mm (of the MVT (Modified Varestraint-Transvarestraint) hot-crack test) of the BAM (German Federal Institute for Materials Research and Testing).

| | Total length of solidification and melting cracks in mm | | |
|---|---|---|---|
| For bending strain | Hot-cracking safe (Range 1) | Increasing hot-cracking tendency (Range 2) | At risk of hot cracking (Range 3) |
| 4% | ≤15 | ≤30 | >30 |

TABLE 3a

Composition of the laboratory batches and of the industrial comparison batches, Part 1. All values in mass-% (T: alloy according to the prior art, E: alloy according to the invention, L: melted on the laboratory scale, G: melted on the industrial scale)

| | | Designation (material no.) | Batch # | C | N | Cr | Ni | Mn | Si | Fe | Al | Mg | Ca | Nb | Co | Fe |
|---|---|---|---|---|---|---|---|---|---|---|---|---|---|---|---|---|
| T | G | AC66 (14877) | 157079 | 0.056 | 0.022 | 27.1 | 31.8 | 0.51 | 0.21 | 39.0 | 0.01 | 0.0006 | <0.0005 | 0.78 | 0.14 | 7.03 |
| T | G | 45TM (24889) | 132330 | 0.067 | 0.101 | 27.2 | 46.3 | 0.12 | 2.60 | 23.1 | 0.16 | 0.014 | 0.001 | 0.02 | 0.04 | −0.45 |
| | L | Ni44Si0.9Al.05Cr28sE | 2095 | 0.063 | 0.101 | 28.1 | 44.0 | 0.01 | 0.88 | 26.6 | 0.05 | 0.0004 | 0.002 | 0.02 | 0.01 | 7.29 |
| | L | Ni34Si0.8Al.05Cr28sE | 2102 | 0.073 | 0.118 | 27.8 | 33.8 | 0.01 | 0.81 | 37.2 | 0.05 | 0.0005 | 0.001 | 0.02 | 0.01 | 4.65 |
| | L | Ni45Si1.4Al.07Cr29sE | 2093 | 0.071 | 0.100 | 29.0 | 45.2 | 0.01 | 1.44 | 23.9 | 0.07 | 0.0004 | 0.003 | 0.01 | 0.01 | 4.99 |
| | L | Ni34Si1.4Al.03Cr28sE | 2101 | 0.069 | 0.104 | 27.9 | 34.0 | 0.01 | 1.37 | 36.3 | 0.03 | 0.0005 | 0.001 | 0.02 | 0.01 | 2.23 |
| | L | Ni34Si1.4Al1.3Cr28sE | 2103 | 0.072 | 0.126 | 28.0 | 33.7 | 0.01 | 1.38 | 35.2 | 1.34 | 0.0006 | 0.002 | 0.02 | 0.01 | −3.68 |
| | L | Ni44Si2.0Al.06Cr28sE | 2091 | 0.072 | 0.081 | 27.8 | 44.3 | 0.01 | 2.02 | 25.4 | 0.06 | 0.0004 | 0.002 | 0.02 | 0.01 | 2.09 |
| | L | Ni45Si1.4Al1.4Cr28sE | 2096 | 0.073 | 0.093 | 28.2 | 44.8 | 0.01 | 1.39 | 24.0 | 1.36 | 0.0009 | 0.002 | 0.02 | 0.01 | −0.60 |
| | L | Ni44Si1.4Al0.8Cr28sE | 2097 | 0.079 | 0.093 | 27.8 | 44.5 | 0.01 | 1.37 | 25.1 | 0.84 | 0.0007 | 0.004 | 0.02 | 0.01 | 1.69 |
| | L | Ni44Si1.4Al.15Cr28sE | 2098 | 0.072 | 0.097 | 27.8 | 44.7 | 0.01 | 1.42 | 25.6 | 0.15 | 0.0005 | 0.003 | 0.02 | 0.01 | 4.56 |
| | L | Ni44Si1.9Al.05Cr28sE | 2099 | 0.066 | 0.100 | 27.8 | 44.7 | 0.01 | 1.94 | 25.2 | 0.05 | 0.0004 | 0.002 | 0.02 | 0.01 | 2.62 |
| | L | Ni35Si2.0Al.05Cr28sE | 2100 | 0.067 | 0.101 | 28.1 | 34.6 | 0.01 | 1.98 | 34.8 | 0.05 | 0.0005 | 0.002 | 0.02 | 0.01 | −0.48 |
| | L | Ni38Si1.5Al0.9Cr28sE | 2200 | 0.077 | 0.108 | 29.1 | 38.5 | <0.01 | 1.51 | 29.6 | 0.87 | 0.0003 | 0.001 | 0.02 | <0.01 | −0.81 |
| | L | Ni44Si1.5Al0.9Cr28La | 2203 | 0.078 | 0.092 | 28.5 | 44.3 | 0.01 | 1.53 | 24.5 | 0.86 | 0.005 | 0.0004 | 0.02 | 0.01 | 0.82 |
| | L | Ni44Si1.5Al0.8Cr28LaMn | 2207 | 0.068 | 0.091 | 28.2 | 44.6 | 0.35 | 1.53 | 24.2 | 0.83 | 0.007 | 0.0002 | 0.02 | 0.01 | 1.03 |
| | L | Ni38Si1.5Al0.9Cr28La | 2208 | 0.069 | 0.096 | 28.3 | 38.9 | 0.01 | 1.56 | 30.0 | 0.87 | 0.006 | 0.0003 | 0.02 | 0.01 | −0.91 |
| | L | Ni38Si1.5Al0.9Cr28LaZrHf | 2209 | 0.070 | 0.092 | 28.4 | 38.1 | 0.01 | 1.52 | 30.8 | 0.90 | 0.006 | 0.0004 | 0.02 | 0.01 | −1.12 |
| | L | Ni38Si0.4Al0.8Cr28sE | 250103 | 0.072 | 0.082 | 27.3 | 38.2 | 0.01 | 0.36 | 33.3 | 0.82 | 0.0006 | 0.003 | 0.02 | 0.01 | 4.62 |
| | L | Ni38Si1.0Al0.2Cr28sE | 250099 | 0.072 | 0.078 | 27.7 | 38.4 | 0.01 | 1.00 | 32.1 | 0.20 | 0.0003 | 0.003 | 0.02 | 0.01 | 4.45 |
| | L | Ni35Si1.0Al0.2Cr28sE | 250104 | 0.078 | 0.097 | 27.4 | 35.5 | 0.01 | 1.00 | 35.8 | 0.21 | 0.0004 | 0.002 | 0.02 | 0.01 | 3.56 |
| | L | Ni38Si1.0Al0.4Cr28sE | 250100 | 0.072 | 0.088 | 27.9 | 38.2 | 0.01 | 0.99 | 32.1 | 0.43 | 0.0004 | 0.003 | 0.02 | 0.01 | 3.43 |
| E | L | Ni35Si0.6Al1.0Cr28sE | 250084 | 0.072 | 0.094 | 27.9 | 35.5 | 0.01 | 0.59 | 33.3 | 0.95 | 0.0003 | 0.001 | 0.02 | 0.01 | 2.21 |
| T | L | Ni38Si0.9Al1.0Cr28sE | 250085 | 0.069 | 0.098 | 27.8 | 38.4 | 0.01 | 0.90 | 31.3 | 0.98 | 0.0005 | 0.001 | 0.02 | 0.01 | 1.47 |
| E | L | Ni35Si1.0Al0.8Cr28sE | 250106 | 0.076 | 0.091 | 27.1 | 35.6 | 0.01 | 0.98 | 35.3 | 0.80 | 0.0005 | 0.002 | 0.02 | 0.01 | 1.08 |
| | L | Ni44Si1.2Al0.8Cr28sE | 250098 | 0.079 | 0.071 | 27.7 | 44.0 | 0.01 | 1.20 | 24.5 | 0.82 | 0.0005 | 0.005 | 0.02 | 0.01 | 2.43 |
| T | L | Ni38Si1.0Al0.8Cr28sE | 250101 | 0.070 | 0.096 | 27.5 | 38.2 | 0.01 | 1.01 | 32.4 | 0.75 | 0.0005 | 0.003 | 0.02 | 0.01 | 1.94 |
| E | L | Ni35Si1.1Al0.5Cr27sE | 250105 | 0.073 | 0.094 | 27.3 | 35.3 | 0.01 | 1.05 | 36.0 | 0.52 | 0.0006 | 0.003 | 0.02 | 0.01 | 1.91 |
| E | L | Ni35Si0.7Al0.9Cr27sE | 250108 | 0.081 | 0.087 | 27.2 | 35.3 | 0.01 | 0.70 | 35.6 | 0.86 | 0.0006 | 0.003 | 0.02 | 0.01 | 2.02 |
| T | L | Ni38Si1.3Al0.8Cr27sE | 250102 | 0.070 | 0.078 | 27.4 | 38.2 | 0.01 | 1.25 | 32.2 | 0.81 | 0.0005 | 0.004 | 0.02 | 0.01 | 0.56 |
| E | L | Ni35Si1.3Al0.9Cr27sE | 250107 | 0.080 | 0.088 | 27.3 | 35.1 | 0.01 | 1.25 | 35.4 | 0.88 | 0.0006 | 0.003 | 0.02 | 0.01 | −0.65 |

TABLE 3b

Composition of the laboratory batches and of the industrial comparison batches, Part 2. All values in mass-% (The following values apply for all alloys: W: <0.01; Y: <0.01; Pb: max. 0.002%, Zn: max. 0.002%, Sn: max. 0.002%) (See Table 3a for the meaning of T, E, G, L)

| | | Designation (material no.) | Batch # | S | Mo | Ti | Cu | P |
|---|---|---|---|---|---|---|---|---|
| T | G | AC66 (14877) | 157079 | 0.002 | 0.05 | <0.01 | 0.05 | 0.010 |
| T | G | 45TM (24889) | 132330 | 0.003 | <0.01 | 0.01 | 0.01 | 0.009 |
| | L | Ni44Si0.9Al.05Cr28sE | 2095 | 0.005 | 0.01 | 0.01 | 0.01 | 0.002 |
| | L | Ni34Si0.8Al.05Cr28sE | 2102 | 0.002 | 0.01 | 0.01 | 0.01 | 0.002 |
| | L | Ni45Si1.4Al.07Cr29sE | 2093 | 0.002 | 0.01 | 0.01 | 0.01 | 0.002 |
| | L | Ni34Si1.4Al.03Cr28sE | 2101 | 0.003 | 0.01 | 0.01 | 0.01 | 0.002 |
| | L | Ni34Si1.4Al1.3Cr28sE | 2103 | 0.003 | 0.01 | 0.01 | 0.01 | 0.003 |
| | L | Ni44Si2.0Al.06Cr28sE | 2091 | 0.002 | 0.01 | 0.01 | 0.01 | 0.002 |
| | L | Ni45Si1.4Al1.4Cr28sE | 2096 | 0.004 | 0.01 | 0.01 | 0.01 | 0.002 |
| | L | Ni44Si1.4Al0.8Cr28sE | 2097 | 0.004 | 0.01 | 0.01 | 0.01 | 0.002 |
| | L | Ni44Si1.4Al.15Cr28sE | 2098 | 0.004 | 0.01 | 0.01 | 0.01 | 0.002 |
| | L | Ni44Si1.9Al.05Cr28sE | 2099 | 0.003 | 0.01 | 0.01 | 0.01 | 0.002 |
| | L | Ni35Si2.0Al.05Cr28sE | 2100 | 0.003 | 0.01 | 0.01 | 0.01 | 0.002 |
| | L | Ni38Si1.5Al0.9Cr28sE | 2200 | 0.003 | <0.01 | 0.01 | <0.01 | 0.003 |
| | L | Ni44Si1.5Al0.9Cr28La | 2203 | 0.006 | 0.01 | 0.01 | 0.01 | 0.003 |
| | L | Ni44Si1.5Al0.8Cr28LaMn | 2207 | 0.005 | 0.01 | 0.01 | 0.01 | 0.003 |
| | L | Ni38Si1.5Al0.9Cr28La | 2208 | 0.005 | 0.01 | 0.01 | 0.01 | 0.003 |
| | L | Ni38Si1.5Al0.9Cr28LaZrHf | 2209 | 0.002 | 0.01 | 0.01 | 0.01 | 0.003 |
| | L | Ni38Si0.4Al0.8Cr28sE | 250103 | 0.003 | 0.01 | 0.01 | 0.01 | 0.002 |
| | L | Ni38Si1.0Al0.2Cr28sE | 250099 | 0.004 | 0.01 | 0.01 | 0.01 | 0.002 |
| | L | Ni35Si1.0Al0.2Cr28sE | 250104 | 0.003 | 0.01 | 0.01 | 0.01 | 0.002 |
| | L | Ni38Si1.0Al0.4Cr28sE | 250100 | 0.004 | 0.01 | 0.01 | 0.01 | 0.002 |
| E | L | Ni35Si0.6Al1.0Cr28sE | 250084 | 0.002 | 0.01 | 0.01 | 0.01 | 0.002 |
| T | L | Ni38Si0.9Al1.0Cr28sE | 250085 | 0.002 | 0.01 | 0.01 | 0.01 | 0.002 |
| E | L | Ni35Si1.0Al0.8Cr28sE | 250106 | 0.003 | 0.01 | 0.01 | 0.01 | 0.002 |
| | L | Ni44Si1.2Al0.8Cr28sE | 250098 | 0.005 | 0.01 | 0.01 | 0.01 | 0.002 |
| T | L | Ni38Si1.0Al0.8Cr28sE | 250101 | 0.004 | 0.01 | 0.01 | 0.01 | 0.002 |
| E | L | Ni35Si1.1Al0.5Cr27sE | 250105 | 0.003 | 0.01 | 0.01 | 0.01 | 0.002 |
| E | L | Ni35Si0.7Al0.9Cr27sE | 250108 | 0.003 | 0.01 | 0.01 | 0.01 | 0.002 |
| T | L | Ni38Si1.3Al0.8Cr27sE | 250102 | 0.004 | 0.01 | 0.01 | 0.01 | 0.002 |
| E | L | Ni35Si1.3Al0.9Cr27sE | 250107 | 0.003 | 0.01 | 0.01 | 0.01 | 0.002 |

| | | | V | sE | La | Ce | Zr | Hf | B | O | FRE |
|---|---|---|---|---|---|---|---|---|---|---|---|
| | T | G | 0.07 | 0.14 | — | — | — | — | 0.004 | — | 0.100 |
| | T | G | 0.03 | 0.14 | — | 0.08 | — | — | <0.0005 | — | 0.087 |
| | | L | 0.01 | 0.05 | 0.02 | 0.03 | 0.002 | <0.001 | 0.001 | 0.006 | 0.035 |
| | | L | 0.01 | 0.07 | 0.02 | 0.04 | 0.002 | <0.001 | 0.001 | 0.005 | 0.046 |
| | | L | 0.01 | 0.06 | 0.02 | 0.04 | 0.002 | <0.001 | 0.0005 | 0.007 | 0.046 |
| | | L | 0.01 | 0.08 | 0.02 | 0.04 | 0.002 | <0.001 | 0.0005 | 0.004 | 0.046 |
| | | L | 0.01 | 0.08 | 0.03 | 0.05 | 0.005 | <0.001 | 0.0005 | 0.002 | 0.060 |
| | | L | 0.01 | 0.05 | 0.02 | 0.03 | 0.002 | <0.001 | 0.0008 | 0.009 | 0.035 |
| | | L | 0.01 | 0.08 | 0.02 | 0.04 | 0.005 | <0.001 | 0.0005 | 0.005 | 0.049 |
| | | L | 0.01 | 0.08 | 0.02 | 0.04 | 0.004 | <0.001 | 0.0005 | 0.005 | 0.048 |
| | | L | 0.01 | 0.09 | 0.03 | 0.06 | 0.003 | <0.001 | 0.0005 | 0.002 | 0.069 |
| | | L | 0.01 | 0.07 | 0.02 | 0.04 | 0.002 | <0.001 | 0.0005 | 0.003 | 0.046 |
| | | L | 0.07 | 0.07 | 0.02 | 0.04 | 0.002 | <0.001 | 0.0005 | 0.004 | 0.046 |
| | | L | 0.01 | 0.06 | 0.02 | 0.04 | 0.004 | <0.001 | <0.0005 | 0.004 | 0.050 |
| | | L | 0.01 | — | 0.06 | 0.002 | 0.005 | <0.001 | 0.003 | 0.003 | 0.053 |
| | | L | 0.01 | — | 0.08 | 0.002 | 0.008 | <0.001 | 0.0005 | 0.002 | 0.069 |
| | | L | 0.01 | — | 0.10 | 0.003 | 0.005 | <0.001 | 0.004 | 0.002 | 0.076 |
| | | L | 0.01 | — | 0.11 | 0.004 | 0.06 | 0.05 | 0.004 | 0.002 | 0.175 |
| | | L | 0.01 | 0.09 | 0.03 | 0.06 | 0.001 | <0.001 | 0.0005 | 0.001 | 0.063 |
| | | L | 0.01 | 0.09 | 0.02 | 0.05 | 0.001 | <0.001 | 0.0005 | 0.004 | 0.053 |
| | | L | 0.01 | 0.08 | 0.03 | 0.06 | 0.001 | <0.001 | 0.0005 | 0.003 | 0.063 |
| | | L | 0.01 | 0.04 | 0.02 | 0.03 | 0.001 | <0.001 | 0.0005 | 0.001 | 0.035 |
| | E | L | 0.01 | 0.03 | 0.02 | 0.03 | 0.002 | <0.001 | 0.0005 | 0.0001 | 0.040 |
| | T | L | 0.01 | 0.07 | 0.02 | 0.05 | 0.002 | <0.001 | 0.0005 | 0.003 | 0.052 |
| | E | L | 0.01 | 0.03 | 0.01 | 0.02 | 0.001 | <0.001 | 0.0005 | 0.003 | 0.027 |
| | | L | 0.01 | 0.09 | 0.03 | 0.05 | 0.001 | <0.001 | 0.0006 | 0.002 | 0.060 |
| | T | L | 0.01 | 0.04 | 0.01 | 0.03 | 0.001 | <0.001 | 0.0005 | 0.001 | 0.031 |
| | E | L | 0.01 | 0.06 | 0.02 | 0.04 | 0.001 | <0.001 | 0.0005 | 0.002 | 0.040 |
| | E | L | 0.01 | 0.05 | 0.02 | 0.03 | 0.001 | <0.001 | 0.0005 | 0.002 | 0.034 |
| | T | L | 0.01 | 0.08 | 0.02 | 0.05 | 0.001 | <0.001 | 0.0006 | 0.005 | 0.051 |
| | E | L | 0.01 | 0.04 | 0.01 | 0.03 | 0.001 | <0.001 | 0.0005 | 0.003 | 0.028 |

TABLE 4

Results a) of the corrosion tests at 500 °C after 1056 hours in an atmosphere of 60% CO, 30% $H_2$, 4% $CO_2$, 1% $H_2S$, 0.05% HCl and 3.95% $H_2O$, b) of the weldability classification by means of MVT test and c) of the hot tension tests at 500 °C

| | Designation | Batch | Corrosion at 500 °C | | | Welding | Mean grain dia. | Tension test at 500 °C | | | |
|---|---|---|---|---|---|---|---|---|---|---|---|
| | (material no.) | # | $M_{gross}$ in g/m² | Spalling | Fc | range | in µm | $R_{p02}$ in MPA | $R_m$ in MPA | $A_5$ in % | Z in % |
| T | AC66 (14877) | 157079 | 10.92 | yes | 7.03 | 2 | 118 | | | | |
| T | 45TM (24889) | 132330 | 0.125 | no | −0.45 | 3 | 174 | | | | |
| | Ni44Si0.9Al.05Cr28sE | 2095 | | | 7.29 | 1 | 189 | 258 | 542 | | |
| | Ni34Si0.8Al.05Cr28sE | 2102 | | | 4.65 | 1 | 174 | 309 | 551 | | |
| | Ni45Si1.4Al.07Cr29sE | 2093 | | | 4.99 | 2 | 125 | | | | |
| | Ni34Si1.4Al.03Cr28sE | 2101 | | | 2.23 | 2 | 189 | | | | |
| | Ni34Si1.4Al1.3Cr28sE | 2103 | | | −3.68 | 3 | 52 | | | | |
| | Ni44Si2.0Al.06Cr28sE | 2091 | | | 2.09 | 3 | 96 | | | | |
| | Ni45Si1.4Al1.4Cr28sE | 2096 | | | −0.60 | 3 | 115 | | | | |
| | Ni44Si1.4Al0.8Cr28sE | 2097 | | | 1.69 | 3 | 77 | | | | |
| | Ni44Si1.4Al.15Cr28sE | 2098 | | | 4.56 | 3 | 52 | | | | |
| | Ni44Si1.9Al.05Cr28sE | 2099 | | | 2.62 | 3 | 115 | | | | |
| | Ni35Si2.0Al.05Cr28sE | 2100 | | | −0.48 | 3 | | | | | |
| | Ni38Si1.5Al0.9Cr28sE | 2200 | | | −0.81 | 3 | | 338 | 579 | | |
| | Ni44Si1.5Al0.9Cr28La | 2203 | | | 0.82 | 3 | | | | | |
| | Ni44Si1.5Al0.8Cr28LaMn | 2207 | | | 1.03 | 3 | | | | | |
| | Ni38Si1.5Al0.9Cr28La | 2208 | | | −0.91 | 3 | | | | | |
| | Ni38Si1.5Al0.9Cr28LaZrHf | 2209 | 0.08 | no | −1.12 | 3 | | | | | |
| | Ni38Si0.4Al0.8Cr28sE | 250103 | 8.01 | yes | 4.62 | 1 | 119 | 182 | 213 | 57.8 | 59 |
| | Ni38Si1.0Al0.2Cr28sE | 250099 | 5.35 | yes | 4.45 | 1 | 145 | 202 | 229 | 59.4 | 60 |
| | Ni35Si1.0Al0.2Cr28sE | 250104 | 3.42 | yes | 3.56 | 1 | 134 | 172 | 202 | 58.0 | 59 |
| | Ni38Si1.0Al0.4Cr28sE | 250100 | 2.30 | yes | 3.43 | 1 | 161 | 156 | 189 | 62.9 | 59 |
| E | Ni35Si0.6Al1.0Cr28sE | 250084 | 1.43 | yes | 2.21 | 1 | 106 | 153 | 193 | 47.0 | 42 |
| T | Ni38Si0.9Al1.0Cr28sE | 250085 | 1.70 | yes | 1.47 | 1 | 103 | 164 | 198 | 47.1 | 37 |
| E | Ni35Si1.0Al0.8Cr28sE | 250106 | 1.28 | yes | 1.08 | 1 | 117 | 176 | 212 | 54.0 | 56 |
| | Ni44Si1.2Al0.8Cr28sE | 250098 | 1.22 | no | 2.43 | 2 | 97 | 166 | 210 | 57.9 | 48 |
| T | Ni38Si1.0Al0.8Cr28sE | 250101 | 1.00 | no | 1.94 | 1 | 109 | 197 | 232 | 57.6 | 55 |
| E | Ni35Si1.1Al0.5Cr27sE | 250105 | 1.19 | no | 1.91 | 1 | 140 | 155 | 192 | 58.4 | 57 |
| E | Ni35Si0.7Al0.9Cr27sE | 250108 | 0.58 | no | 2.02 | 1 | 110 | 174 | 213 | 51.2 | 56 |
| T | Ni38Si1.3Al0.8Cr27sE | 250102 | 0.50 | no | 0.56 | 2 | 122 | 170 | 204 | 53.7 | 45 |
| E | Ni35Si1.3Al0.9Cr27sE | 250107 | 0.41 | no | −0.65 | 1 | 105 | 164 | 202 | 54.1 | 48 |

Figure 1:
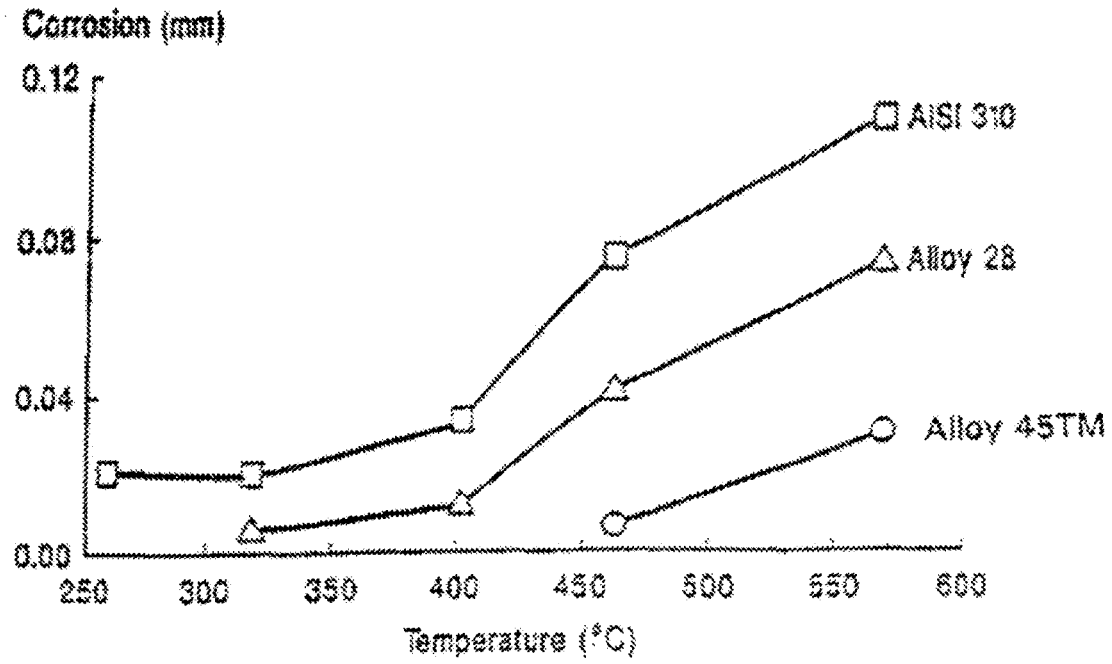
FIG. 1: Corrosion attack depth in various alloys after exposure for 2100 hours in a Prenflo pilot plant in an $H_2S$-containing gas as a function of temperature.
Figure 1:
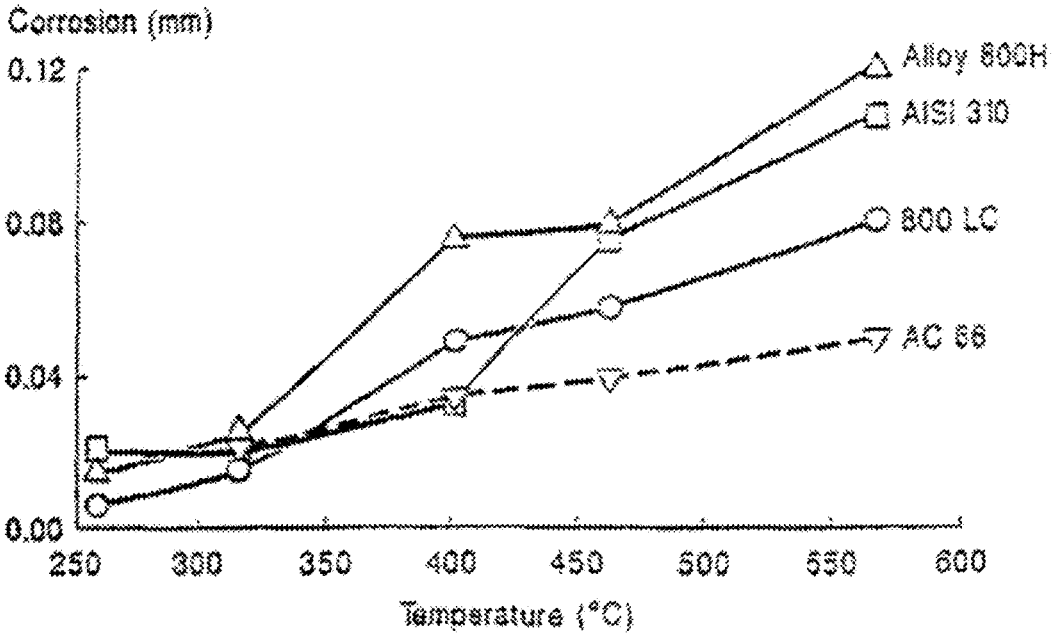

The invention claimed is:

1. A method of using, as a semifinished product, a nickel-iron-chromium-alloy that has excellent high-temperature corrosion resistance in an environment that is simultaneously carburizing, sulfidizing and chlorinating, and the nickel-iron-chromium-alloy contains (in mass-%):

35.0 to 38% nickel, 26.0 to 30.0% chromium,

>0.7 to 1.50% silicon, 0.40 to 1.30% aluminum, 0.00 to 1.0% manganese, respectively 0.0001 to 0.05% magnesium and/or calcium, 0.015 to 0.12% carbon, 0.001 to 0.150% nitrogen, 0.001 to 0.030% phosphorus, 0.0001 to 0.020% oxygen, at most 0.010% sulfur, less than 1.0% molybdenum, less than 1.0% cobalt, less than 0.5% copper, less than 1.0% tungsten, the rest iron and the usual process-related impurities, wherein the following relationship must be satisfied:

$$Fc = -1.2 + 0.29 * \mathrm{Ni} - 4.6 * \mathrm{Si} - 4.4 * \mathrm{Al} \leq 2.5, \quad (1a)$$

wherein Ni, Si and Al are the concentrations of the elements in question in mass-%, wherein the method comprises:

providing the nickel-iron-chromium-alloy; and using the nickel-iron-chromium-alloy as the semifinished product in the environment.

2. The method according to claim 1, wherein the nickel-iron-chromium-alloy has a nickel content of >35.0 to <38%.

3. The method according to claim 1, with wherein the nickel-iron-chromium-alloy has a chromium content of >26.0 to 30.0%.

4. The method according to claim 1, with wherein the nickel-iron-chromium-alloy has an aluminum content of ≥0.50% or >0.50% to <1.30%.

5. The method according to claim 1, wherein the nickel-iron-chromium-alloy has a residual iron content of 28.0 or >28.0 to 38.0%.

6. The method according to claim 1, wherein the nickel-iron-chromium-alloy has 0.0001 to 0.20% respectively of one or more of the elements cerium, lanthanum, yttrium, zirconium and hafnium, wherein the following formula must be satisfied:

$$FRE = 0.714 * \mathrm{Ce} + 0.720 * \mathrm{La} + 1.124 * \mathrm{Y} + 1.096 * \mathrm{Zr} + 0.560 * \mathrm{Hf} \leq 0.10 \quad (2a)$$

wherein Ce, La, Y, Zr, and Hf are the concentrations of the elements in question in mass-%.

7. The method according to claim 1, in which, in case of simultaneous presence of cerium and lanthanum, cerium mixed metal (abbreviation CeMM) is also used, in contents of 0.001 to 0.20%, wherein FRE must be modified as follows:

$$FRE = 0.716 * CeMM + 1.124 * Y + 1.096 * Zr + 0.560 * Hf \leq 0.10 \quad (3a)$$

wherein CeMM, Y, Zr, and Hf are the concentrations of the elements in question in mass-%.

8. The method according to claim 1, wherein the nickel-iron-chromium-alloy has optionally a titanium content of 0.0 to 0.50%.

9. The method according to claim 1, wherein the nickel-iron-chromium-alloy has optionally with a niobium and/or tantalum content of respectively 0.0 to 0.50%.

10. The method according to claim 1, wherein the nickel-iron-chromium-alloy has optionally with a content of boron of 0.0001 to 0.008%.

11. The method according to claim 1, wherein the nickel-iron-chromium-alloy further optionally contains at most 0.50% vanadium.

12. The method according to claim 1, wherein the impurities are adjusted in contents of max. 0.002% lead, max. 0.002% tin, max. 0.002% zinc.

13. The method according to claim 1, wherein the semi-finished product is in the form a strip, a sheet, a wire, a rod, forgings, a longitudinally welded tube, or a seamless tube.

14. The method according to claim 1, wherein the semi-finished product is a component or is used in a component in the chemical industry.

15. The method according to claim 1, wherein the semi-finished product is used in a refuse-incineration plant or in a refuse-pyrolysis plant or in a component in a refuse-incineration plant or in a refuse-pyrolysis plant.

* * * * *